US005950845A

United States Patent [19]

Harris

[11] Patent Number: 5,950,845

[45] Date of Patent: Sep. 14, 1999

[54] FLUSH MOUNTED VALET

[76] Inventor: William R. Harris, 1703 Royal Crescent Dr., San Antonio, Tex. 78231

[21] Appl. No.: 09/148,645

[22] Filed: Sep. 4, 1998

Related U.S. Application Data

[63] Continuation-in-part of application No. 08/785,994, Jan. 21, 1997, Pat. No. 5,819,961.

[51] Int. Cl.[6] ..... A47H 1/00

[52] U.S. Cl. ..... 211/100; 248/294.1; 248/308; 211/99

[58] Field of Search ..... 211/100, 1.3, 99, 211/171; 248/294.1, 308

[56] References Cited

U.S. PATENT DOCUMENTS

| | | | |
|---|---|---|---|
| 882,277 | 3/1908 | Teipel | 211/100 |
| 927,172 | 7/1909 | Sauber | 211/100 |
| 1,435,183 | 11/1922 | Shepherd | 211/99 |
| 1,724,218 | 8/1929 | Nixon | 211/1.3 |
| 2,483,242 | 9/1949 | Smith | 211/1.3 |
| 2,778,705 | 1/1957 | Barker | 211/1.3 X |
| 2,812,068 | 11/1957 | Lord | 211/100 |
| 3,941,250 | 3/1976 | Ott | 211/100 X |
| 4,171,748 | 10/1979 | Fabian | 211/100 X |
| 4,333,575 | 6/1982 | Wong | 211/100 X |
| 4,886,172 | 12/1989 | Kummerlen | 211/100 X |

*Primary Examiner*—Daniel P. Stodola
*Assistant Examiner*—Erica B. Harris
*Attorney, Agent, or Firm*—Jackson Walker L.L.P.

[57] ABSTRACT

A flush, mountable valet having a hanger arm and a support arm. The hanger arm and support arm are retained within a longitudinal channel extending the length of the valet housing. A flat or flush profile is achieved.

1 Claim, 6 Drawing Sheets

FLUSH MOUNTED VALET

BACKGROUND OF THE INVENTION

This application is a continuation-in-part application of U.S. patent application Ser. No. 08/785,994, filed Jan. 21, 1997, now U.S. Pat. No. 5,819,961.

This invention relates to a device for hanging clothing, and more particularly, to a collapsible and foldable valet which results in a streamline, narrow, flush configuration.

There are numerous garment supporters or racks in the prior art. Such devices are disclosed in U.S. Pat. Nos. 984,591; 1,075,395; 1,176,563; and 1,525,701. However, nothing in the prior art teaches the structure of the present invention whereby a valet may be collapsed and folded into the present unique, reduced collapsed configuration while at the same time providing a hanger extension when in the extended position. The prior art generally does not teach providing additional support beneath any outstretched member; thus, the weight of clothing hung from the racks of the prior art often results in the collapse or deformation of the rack. The clothing hung from the prior art racks often becomes twisted and wrinkled, thereby defeating a principal purpose of such racks.

The present invention solves the problems of the prior art by providing a hanger lifting arm which supports the outstretched hanger member when the valet is in use.

SUMMARY OF THE INVENTION

A mountable valet has a housing with a longitudinal channel for receiving a hanger arm and a supporting or lifting arm in a flush or flat profile. An elongated slot in the hanger arm slidably secures a first end of the lifting arm while the second end is held by a pivot pin within the channel. A notch in the bottom edge of the arm receives the pivot pin when the hanger is in the collapsed position.

DETAILED DESCRIPTION OF THE PREFERRED EMBODIMENT

Figure 1:
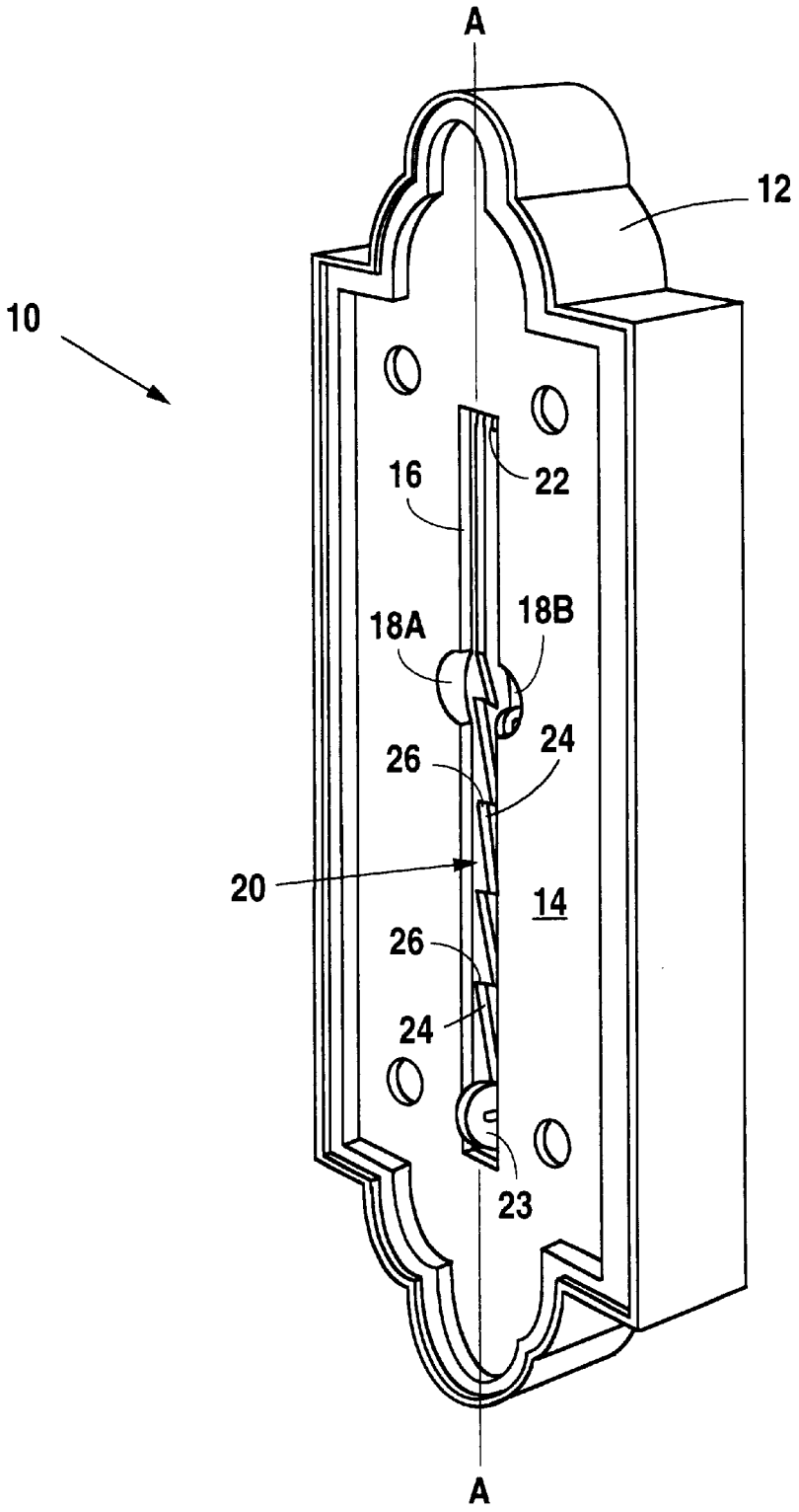
FIG. 1 illustrates a front, right side perspective view of the invention in the folded or collapsed position.

FIG. 1 illustrates the present invention in a folded or collapsed position. The wall mounted valet (10) has a decorative mounting housing (12) which has a longitudinal area (A) and a face (14). A retraction slot (16) extends vertically along the longitudinal axis of the housing (12) and has grasping notches (18A and 18B) along opposite edges of the slot (16). The grasping notches may be moved to the lower section of the bracket as shown in FIG. 2.

A hanger arm member (20) is pivotally attached inside slot (16) at pivot (22) at a top end of the hanger arm (20). Along a top edge (24) of hanger arm (20) are a multiplicity of ramped shoulders (26). At the end opposite the pivot (22) is a bulbous tab (23) which functions both as a means for grasping and lifting the hanger arm (20) and as an end stop for items affixed to the hanger.

Figure 6:
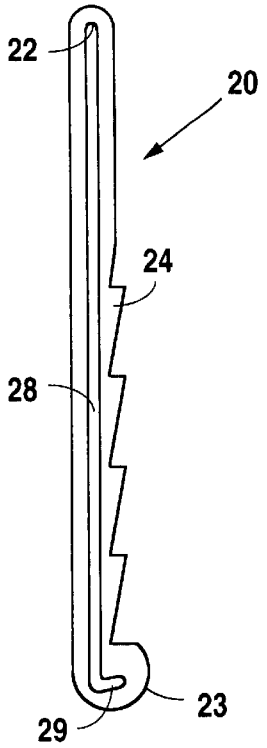
FIG. 6 is a side elevation view of the hanger member of the present invention.
Figure 7:
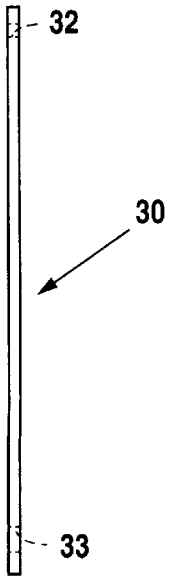
FIG. 7 is a front elevation view of the support arm of the present invention.
Figure 8:
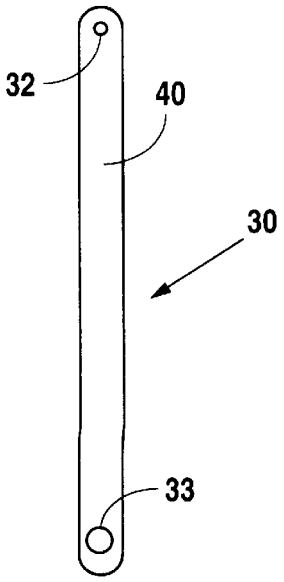
FIG. 8 is a side elevation view of the support arm of the present invention.

As FIG. 6 shows in more detail, the hanger arm member (20) is provided with a slide slot (28) extending from the pivot (22) to the knob (23). A short "L" shaped section is provided in slot (28) at a 78° angle to the vertical to accept the support arm (30) in a locked open position as shown in FIG. 2.

Figure 2:
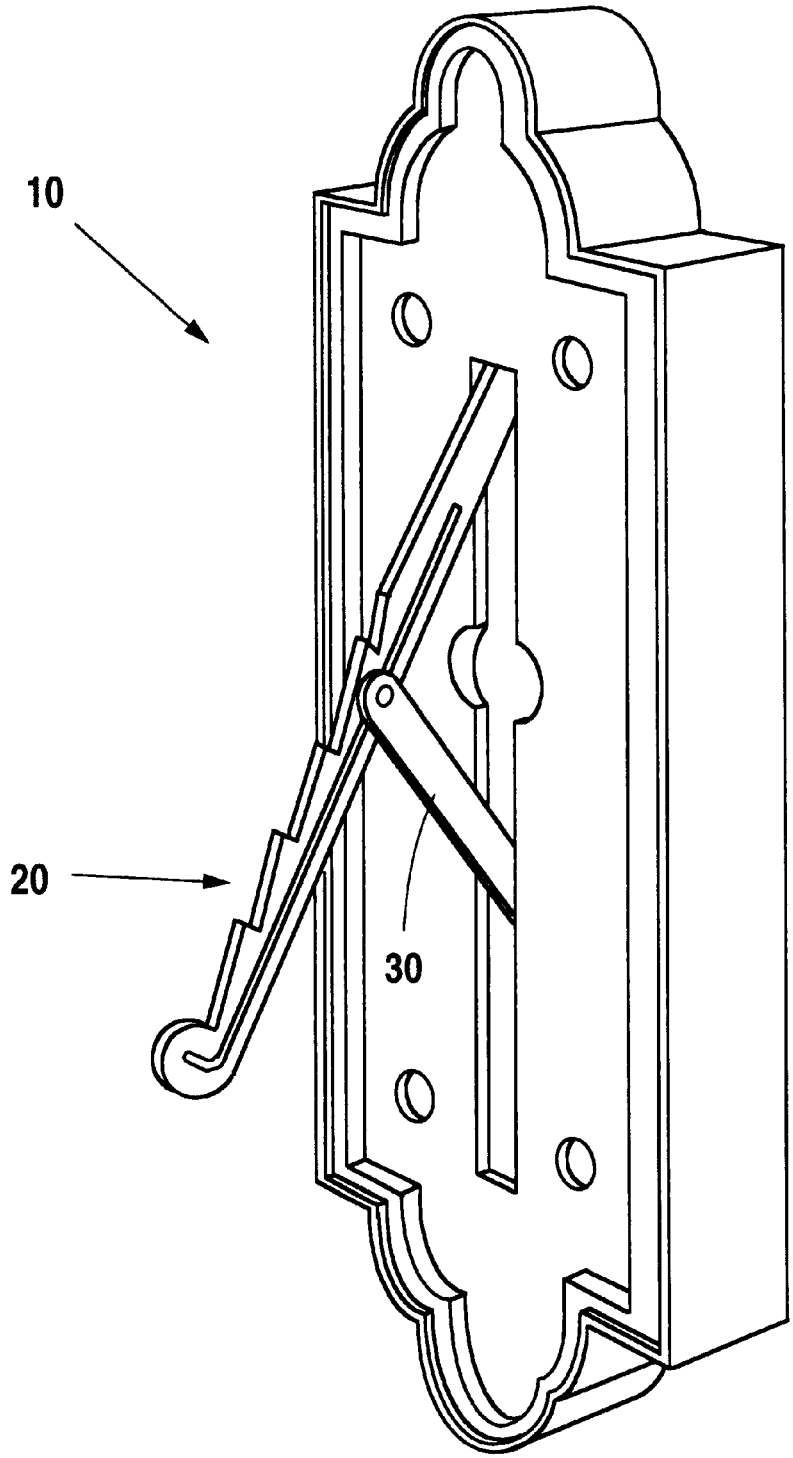
FIG. 2 illustrates a front, right side perspective view of the invention in the open or extended position.

FIG. 2 illustrates the present invention (10) in the open, extended, or raised position with hanger arm member (20) extending outwardly and upwardly from the face (14) of the bracket (12). It may be understood that individual hangered items (not shown) may be placed along the top edge (24) of the hanger and be held by the ramped shoulders (26).

Figure 2A:
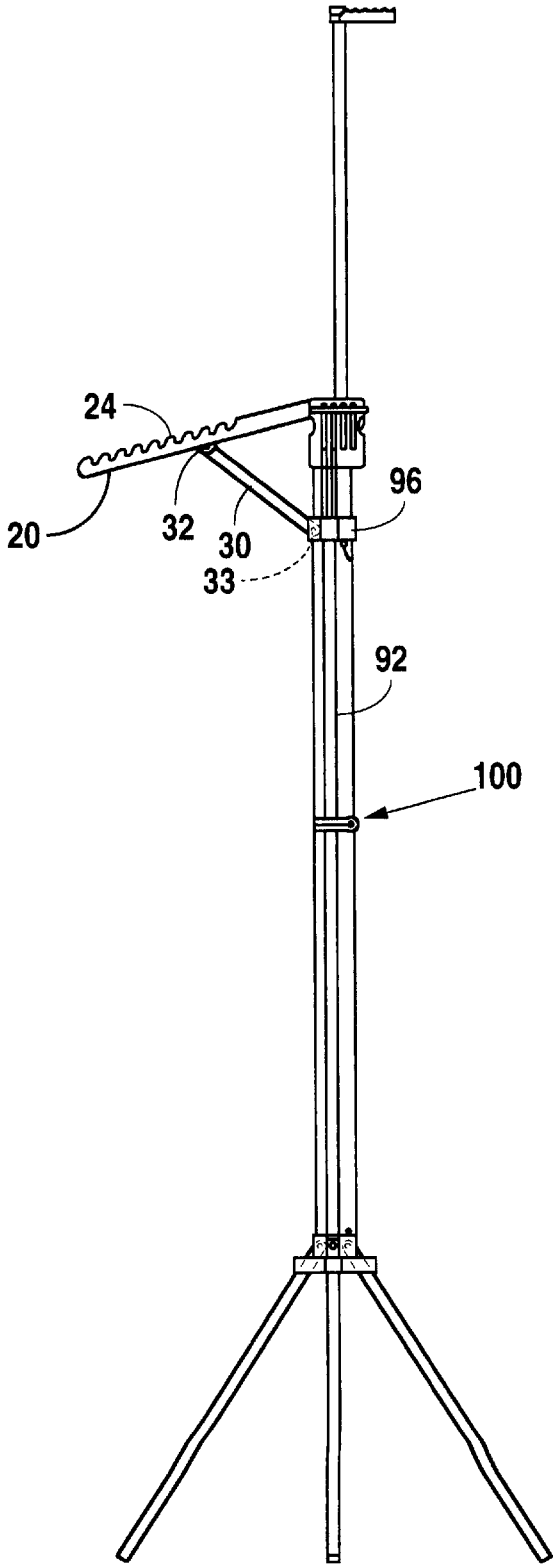
FIG. 2A illustrates a side elevation view of the invention in the extended position in an alternative valet style.

FIG. 2A illustrates the valet hanger arm (20) on a different type of mount (100). Support lifting arm (30) and the ramped shoulders (26) on the top edge (24) of the arm (20) support the hangers in position. The valet is shown in the extended position. The lifting arm (30) is pivotally attached at a first end (33) to the upper sleeve (96) and at a second end (32) to beneath the approximate mid-point of the hanger arm (20). Hanging arm (20) and lifting arm (30) are positioned within a channel (16) and lie parallel to and against the vertical support member (92) when the sleeve (96) is in the collapsed position.

Figure 3:
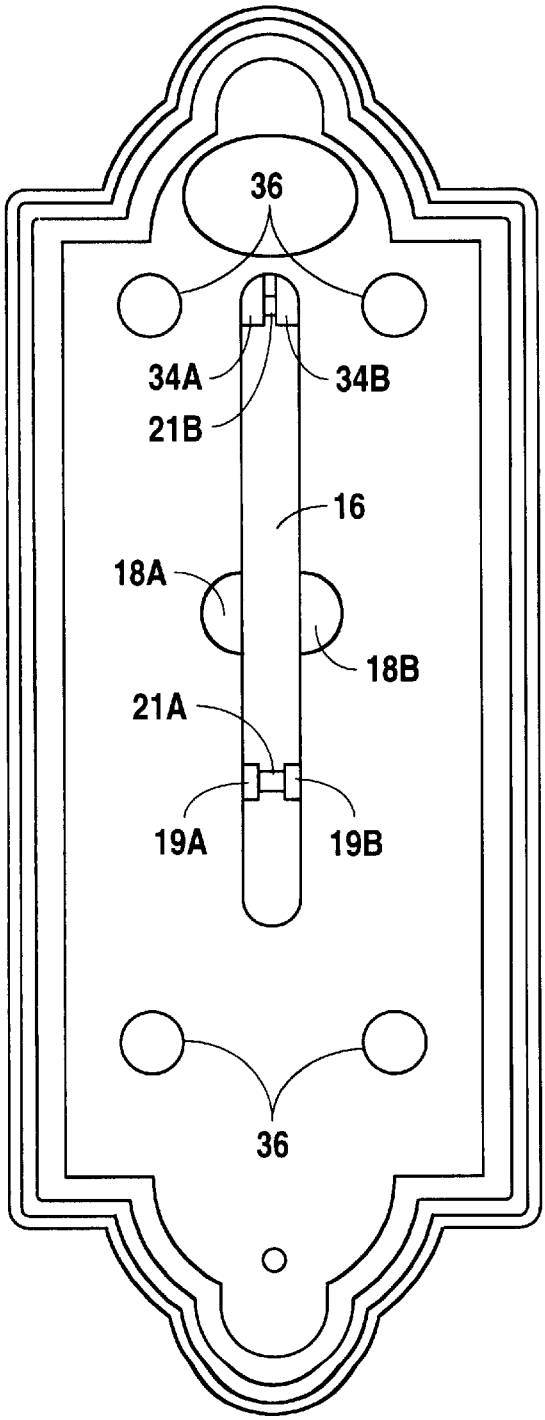
FIG. 3 shows a front elevation view of the mounting bracket of the present invention.
Figure 5:
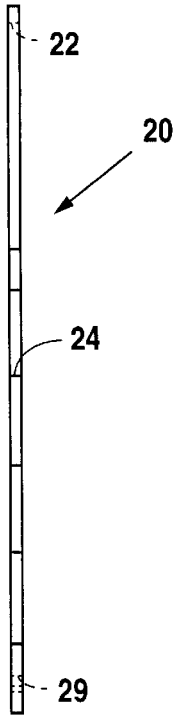
FIG. 5 is a front elevation view of the hanger member of the present invention.

FIG. 3 shows a front elevation view of the mounting bracket (12). Slot (16) extends vertically along the face (14). Grasping notches (18A and 18B) may be seen on opposite sides of slot (16). Nipples (19A and 19B) are formed into the bracket (12) to hold pivot pin (21A) which pivotally supports support arm (30) at support pivot opening (33). The upper end of hanger member (20) is pivotally held in slot (16) at pivot (22) by a pin (21B) passing through member (20) and pivotal between shoulders (34A and 34B) on the bracket (12).

Bracket (12) may be mounted to a wall through openings (36), or other suitable means, using various types of fasteners.

Figure 4:
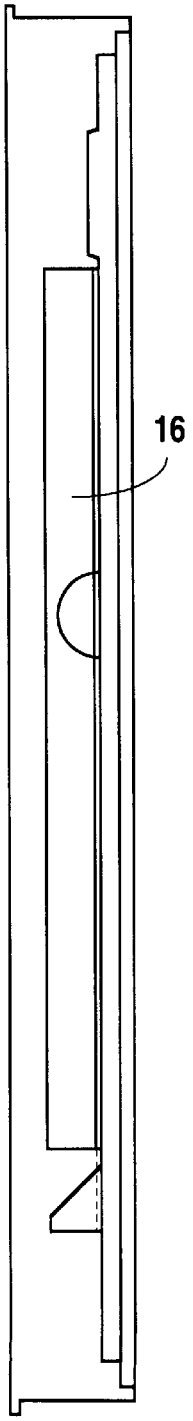
FIG. 4 shows a side elevation view of the mounting bracket of the present invention taken along Line A—A of FIG. 3.

FIG. 4 shows the details of the bracket profile. The recessed slot (16) enables the hanger (20) and support arm (30) to be recessed within the bracket in the folded condition. This yields a smooth flat or flush profile.

FIGS. 5–8 illustrate the construction details of the hanger member (20) and the support arm (30). Of particular importance is the sliding slot (28) with the "L" shaped end (29) angled at 78° from the vertical which enables the hanger to be "locked" in the extended position. A small pin (not shown) passes through the opening (32) in the upper end (40) of arm (30) and into slot (28) to lift and support the hanger (20).

Figure 9:
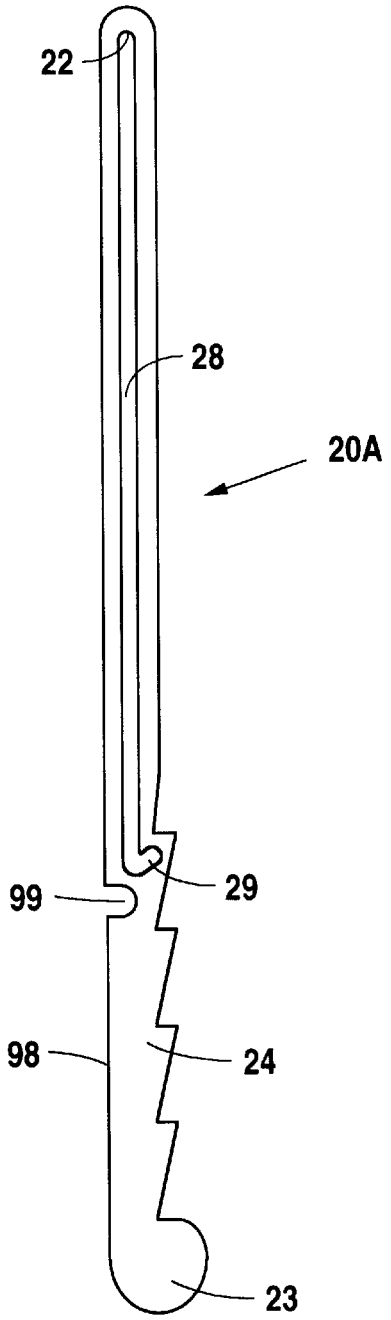
FIG. 9 is a side elevation view of a longer hanger arm of the present invention.

FIG. 9 illustrates another embodiment in which the hanger arm (20A) has an additional length. Slot (28) is provided with lock (29). Along the bottom edge (98) of arm (20A) is a notch (99) which receives pivot pin (21A). This allows the arm (20A) to lie flush in the channel (16) when the longer hanger arm (20A) is used.

Figure 10:
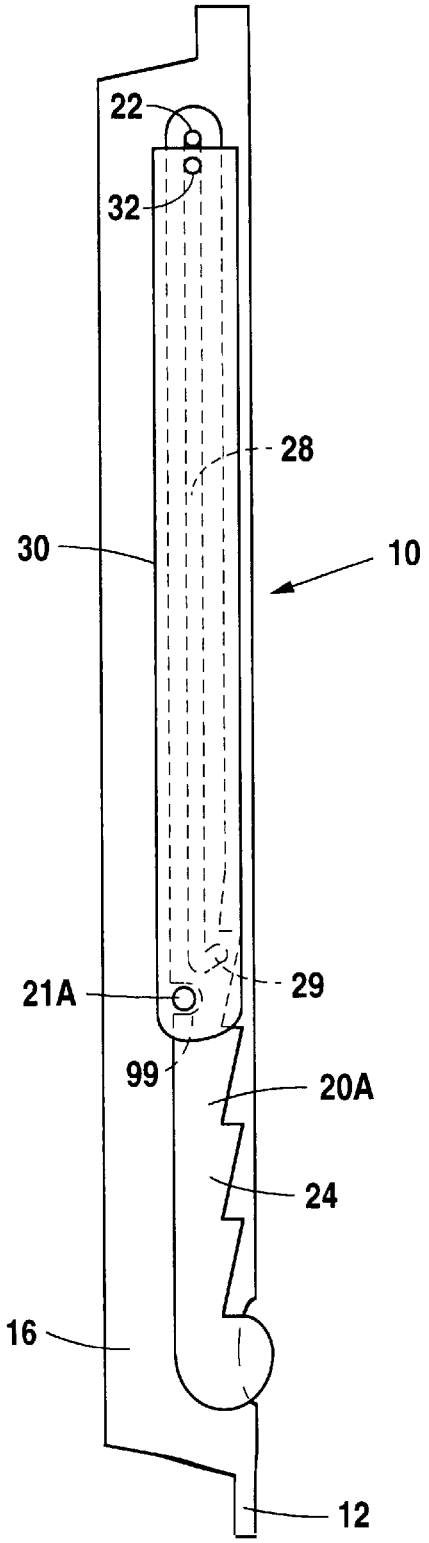
FIG. 10 is a side plan view of the longer arm within a housing.

FIG. 10 illustrates the valet (10) in the collapsed position with pivot pin (21A) received into notch (19) of arm (20A).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that this disclosure and the attached drawings will cover such modifications that fall within the scope of the invention.

I claim:

1. A flush, mountable valet comprising:

a housing having a longitudinal axis;

a channel extending along said axis;

a hanger arm having a first end and a second end, said first end of said arm pivotally attached within a top end of said channel, said arm having a multiplicity of hanger ramps extending along a top edge of said arm;

an elongated slot in said arm extending from said first end to a mid section of said arm;

a first end of a lifting arm attached to said hanger arm and slidable within said slot, said lifting arm pivotally attached at a second end to a pivot pin in an inner wall of said channel, said elongated slot having a generally L-shaped locking groove; and a notch in a bottom edge of said hanger arm to receive said pivot pin extending transversely across said channel when said hanger is in a first collapsed position.

* * * * *